US011701904B2

(12) United States Patent
Sanders et al.

(10) Patent No.: US 11,701,904 B2
(45) Date of Patent: Jul. 18, 2023

(54) FEEDER TRAY ADJUSTABLE LEVELING ASSEMBLY FOR SPECIALTY MEDIA

(71) Applicant: Xerox Corporation, Norwalk, CT (US)

(72) Inventors: Kenneth D. Sanders, Rochester, NY (US); Arthur H. Kahn, Wayland, NY (US); Dara Nanette Lubin, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 198 days.

(21) Appl. No.: 17/194,532

(22) Filed: Mar. 8, 2021

(65) Prior Publication Data

US 2022/0281245 A1 Sep. 8, 2022

(51) Int. Cl.

| | |
|---|---|
| ***B65H 1/26*** | (2006.01) |
| ***B41J 13/10*** | (2006.01) |
| ***B65H 1/04*** | (2006.01) |

(52) U.S. Cl.

CPC ..... *B41J 13/103* (2013.01); *B65H 1/04* (2013.01); *B65H 1/266* (2013.01); *B65H 2701/122* (2013.01)

(58) Field of Classification Search

CPC ..... B65H 2301/3311; B65H 3/66

See application file for complete search history.

(56) References Cited

U.S. PATENT DOCUMENTS

| | | | | |
|---|---|---|---|---|
| 6,283,469 | B1 * | 9/2001 | Weber | B65H 1/14 271/160 |
| 7,458,574 | B2 * | 12/2008 | Wilcox | B65H 1/14 271/148 |
| 8,348,259 | B2 * | 1/2013 | Marasco | B65H 1/14 271/148 |
| 9,248,990 | B2 * | 2/2016 | Morita | B65H 31/02 |
| 11,312,585 | B1 * | 4/2022 | Sanders | G03G 15/6502 |
| 2016/0122141 | A1 * | 5/2016 | Tomaru | B65H 1/266 271/147 |

* cited by examiner

*Primary Examiner* — Howard J Sanders

(74) *Attorney, Agent, or Firm* — Simpson & Simpson, PLLC

(57) ABSTRACT

An adjustable leveling assembly for engaging a stack of a plurality of sheets in a feeder tray of a printing device, including a first wedging element slidably arranged on the feeder tray and operatively arranged to engage the stack, wherein when the first wedging element is disengaged with the stack, a top sheet of the plurality of sheets is non-parallel to the feeder tray, and when the first wedging element is engaged with the stack, the top sheet is substantially parallel to the feeder tray.

15 Claims, 10 Drawing Sheets

FEEDER TRAY ADJUSTABLE LEVELING ASSEMBLY FOR SPECIALTY MEDIA

FIELD

The present disclosure relates to the field of printing, and more particularly, to the field of printing specialty media that results in irregular thickness when stacked, and even more particularly, to an adjustable leveling assembly for specialty media that results in irregular thickness when stacked.

BACKGROUND

Current printers and printing systems allow for the feeding of specialty stocks with cards, labels, and stickers. For example, custom or specialty media or sheets exist that allow for users to print out cards (e.g., business cards, greeting cards, post cards, etc.), labels, stickers etc. These custom sheets might comprise a full sheet geometry with the card, label, and/or sticker arranged at a first end of the end of the sheet.

When too many of these custom sheets are arranged on the feeder tray forming a stack, the top surface of the stack is higher in one corner, at one end of the stack, or in the middle of the stack causing the feeder tray height sensor therein to read incorrectly and cause misfeeds. As such, current printers and printing systems are limited to only stacking small quantities of custom sheets in the feeder tray due to the unlevel geometry of the stack of sheets.

Furthermore, current devices to remedy the unlevel geometry of the stack of custom or specialty sheets only allow for short edge feeding, which users do not prefer due to slower productivity, and provide a flat linear ramp, spring loaded across one side, only allowing for cards with uniform geometry across the end. Such current devices do not allow for media that has one card in a corner or one card or label in the middle.

Therefore, there is a long felt need for an adjustable leveling assembly for specialty media that can be arranged in current print feeder trays to enable level stacks of specialty media.

SUMMARY

According to aspects illustrated herein, there is provided an adjustable leveling assembly for engaging a stack of a plurality of sheets in a feeder tray of a printing device, comprising a first wedging element slidably arranged on the feeder tray and operatively arranged to engage the stack, wherein when the first wedging element is disengaged with the stack, a top sheet of the plurality of sheets is non-parallel to the feeder tray, and when the first wedging element is engaged with the stack, the top sheet is substantially parallel to the feeder tray.

In some embodiments, the adjustable leveling assembly further comprises a body, including a top surface, and a bottom surface operatively arranged to engage the feeder tray, wherein the first wedging element is slidably connected to the body. In some embodiments, the body further comprises a first side wall extending from the top surface to the bottom surface, and a second side wall extending from the top surface to the bottom surface, the second side wall spaced apart from the first side wall. In some embodiments, the first wedging element comprises a first cross-member engaged with the first side wall and the second side wall, a second cross-member engaged with the first side wall and the second side wall, the second cross-member spaced apart from the first cross-member, and at least one surface that extends between the first cross-member and the second cross-member. In some embodiments, the at least one surface comprises a first surface extending from the first cross-member, a second surface extending from the second cross-member, and a third surface connecting the first surface and the second surface. In some embodiments, the first surface and the second surface are planar, and the third surface is curvilinear. In some embodiments, the adjustable leveling assembly further comprises a cutout arranged in at least one of the first surface and the second surface. In some embodiments, the first cross-member and the second cross-member are arranged below the top surface, and the at least one surface is arranged above the top surface. In some embodiments, the top surface comprises an aperture and the at least one surface extends through the aperture. In some embodiments, the adjustable leveling assembly further comprises a first pair of tracks, wherein the first wedging element is engaged with the first pair of tracks via at least one roller. In some embodiments, the adjustable leveling assembly further comprises a second pair of tracks spaced apart from the first pair of tracks and a second wedging element, wherein the second wedging element is engaged with the second pair of tracks. In some embodiments, each track of the first pair of tracks comprises a channel and at least one space. In some embodiments, the adjustable leveling assembly further comprises at least one plate operatively arranged to be removably engaged with the at least one space. In some embodiments, the adjustable leveling assembly further comprising a locking mechanism operatively arranged to fixedly secure the first wedging element with respect to the feeder tray. In some embodiments, the adjustable leveling assembly further comprising a transmission device operatively arranged to transmit data to a remote location. In some embodiments, the first wedging element is slidably displaceable relative to the feeder tray in a direction perpendicular to sheet feeding.

According to aspects illustrated herein, there is provided an adjustable leveling assembly for engaging an unlevel stack of a plurality of sheets in a tray of a printing device, comprising a body, including a top surface, and a bottom surface operatively arranged to engage the tray, and a first wedging element slidably connected to the body, the first wedging element operatively arranged to engage the unlevel stack to form a level stack.

In some embodiments, the top surface comprises an aperture, the body further comprises a first side wall extending from the top surface to the bottom surface, and a second side wall extending from the top surface to the bottom surface, the second side wall spaced apart from the first side wall, and the first wedging element extends through the aperture. In some embodiments, the first wedging element comprises a first cross-member engaged with the first side wall and the second side wall, a second cross-member engaged with the first side wall and the second side wall, and at least one surface that extends between the first cross-member and the second cross-member. In some embodiments, the adjustable leveling assembly further comprises a first channel connected to the first side wall, and a second channel connected to the second side wall, wherein the first wedging element is engaged with the first channel and the second channel via at least one roller. In some embodiments, the adjustable leveling assembly further comprises a third channel connected to the first side wall, a fourth channel connected to the second side wall, and a second wedging element engaged with the third channel and the fourth channel.

According to aspects illustrated herein, there is provided an adjustable leveling assembly for a feeder tray of a printer, comprising a body, including a top surface, and a bottom surface operatively arranged to engage the feeder tray, and a first wedging element slidably connected to the body and operatively arranged to engage a stack of sheets.

In some embodiments, the body further comprises a first side wall extending from the top surface to the bottom surface, and a second side wall extending from the top surface to the bottom surface, the second side wall spaced apart from the first side wall. In some embodiments, the first wedging element comprises a first cross-member engaged with the first side wall and the second side wall, a second cross-member engaged with the first side wall and the second side wall, and at least one surface that extends between the first cross-member and the second cross-member. In some embodiments, the at least one surface comprises a first surface extending from the first cross-member, a second surface extending from the second cross-member, and a third surface connecting the first surface and the second surface. In some embodiments, the first surface and the second surface are planar, and the third surface is curvilinear. In some embodiments, the adjustable leveling assembly further comprises a cutout arranged in at least one of the first surface and the second surface. In some embodiments, the first cross-member and the second cross-member are arranged below the top surface, and the at least one surface is arranged above the top surface. In some embodiments, the top surface comprises an aperture and the at least one surface extends through the aperture. In some embodiments, the adjustable leveling assembly further comprises a first pair of tracks, wherein the first wedging element is engaged with the first pair of tracks via at least one roller. In some embodiments, the adjustable leveling assembly further comprises a second pair of tracks spaced apart from the first pair of tracks and a second wedging element, wherein the second wedging element is engaged with the second pair of tracks. In some embodiments, each track of the first pair of tracks comprises a channel and at least one space. In some embodiments, the adjustable leveling assembly further comprises at least one plate operatively arranged to be removably engaged with the at least one space. In some embodiments, the adjustable leveling assembly further comprises a locking mechanism operatively arranged to fixedly secure the first wedging element to the body. In some embodiments, the adjustable leveling assembly further comprises a transmission device operatively arranged to transmit data to a remote location.

According to aspects illustrated herein, there is provided an adjustable leveling assembly for a feeder tray of a printer, comprising a body, including a top surface including an aperture, a bottom surface operatively arranged to engage the feeder tray, a first side wall extending from the top surface to the bottom surface, and a second side wall extending from the top surface to the bottom surface, the second side wall spaced apart from the first side wall, and a first wedging element slidably connected to the body, extending through the aperture, and operatively arranged to engage a stack of sheets.

In some embodiments, the first wedging element comprises a first cross-member engaged with the first side wall and the second side wall, a second cross-member engaged with the first side wall and the second side wall, and at least one surface that extends between the first cross-member and the second cross-member. in some embodiments, the at least one surface comprises at least one of a planar surface and a curvilinear surface. In some embodiments, the first cross-member and the second cross-member are arranged below the top surface, and the at least one surface is arranged at least partially above the top surface. In some embodiments, the adjustable leveling assembly further comprises a first channel connected to the first side wall and a second channel connected to the second side wall, wherein the first wedging element is engaged with the first channel and the second channel via at least one roller. In some embodiments, the adjustable leveling assembly further comprises a third channel connected to the first side wall, a fourth channel connected to the second side wall, and a second wedging element engaged with the third channel and the fourth channel.

According to aspects illustrated herein, there is provided an adjustable leveling feeder tray, comprising a body, including a top surface, a bottom surface, a first side wall extending from the top surface to the bottom surface, and a second side wall extending from the top surface to the bottom surface, the second side wall spaced apart from the first side wall, and a first wedging element slidably connected to the body, including a first cross-member, a second cross-member, and at least one surface that extends between the first cross-member and the second cross-member, wherein the at least one surface comprises at least one of a planar surface and a curvilinear surface.

According to aspects illustrated herein, there is provided a smart specialty media feeding kit with variable geometry surfaces. The assembly enables specialty media, such as cards, or other additions to the paper surface such as labels, to feed from the tray by changing the geometry of the stack in the feeder tray. The top surface of the pile height of paper is leveled by using a platform placed underneath the stack along with adjustable curved supports underneath the media.

The assembly comprises a rectangular platform and a variety of different shaped curved props and supports that can be moved into an almost infinite number of places or locations on the main platform. Cutouts in the main platform allow the supports to slide into almost any position under the media. The shapes of the curved supports are designed to correct various different types of stacks of media to make the top surface of the stack flat.

The assembly further comprises a wireless component, or a wireless transponder or transmitter, achievable via BLUETOOTH® wireless technology or other radiofrequency identification (RFID) technique, that communicates to a tablet or small screen placed next to the digital front end of the printing device or anywhere else convenient. The screen indicates that the leveling device is installed in the feeder tray (e.g., the screen may display a message: "Smart Feeding Kit Installed. Monitor output at Stacker."). This warning may be necessary because at present, the same paper geometry that hinders feeding (the stack of media prior to entering the printing device, or input) also prevents stacking (the stack of media after exiting the printing device, or output). The user must remember that the capacity for stacking is very limited; even if the user can now place several hundred sheets in the feeder tray by using the smart feeding kit, the sheets in the stacker will be uneven and they will have to unload the sheets while the printing device is running.

The smart feeding kit or assembly is operatively arranged to be placed into any feeder tray of a printing device. In some embodiments, the curved supports or wedging elements can be stored inside the main platform of the kit or assembly. As such, various sized supports can, at the same time, be housed and utilized by the main platform.

In some embodiments, the kit or assembly allows feeding business card stocks and media with irregular thickness in stacks (e.g., multiplatform identification (ID) cards, index inkjet treated ID cards, and any other stocks that will have irregular stack properties). The assembly of the present disclosure enables feeding over 400 sheets at a time into the feeder tray as well long-edge feeding. In some embodiments, the assembly comprises a plurality of peak shapes that can be adjusted to any location on the body surface (i.e., slides linearly there along). In some embodiments, the assembly further comprises a wireless transmission device to alert the user to monitor the output stacker (i.e., the irregular thickness stock will stack uneven in the output stacker and thus must be monitored). The wireless transmission device further communicates its location in the printing device.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
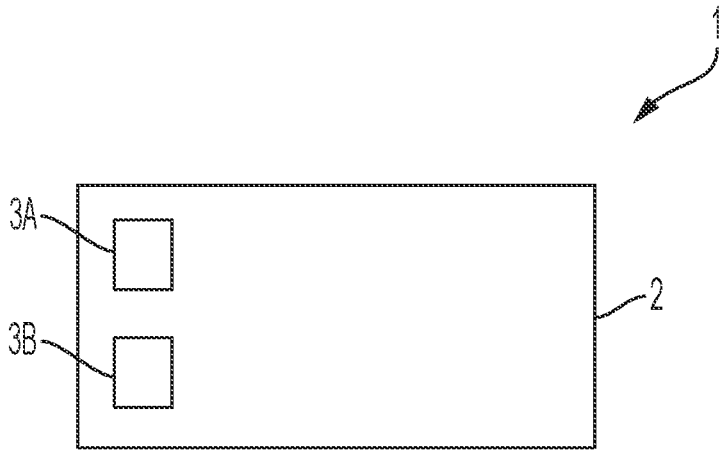
FIG. 1 PRIOR ART
FIG. 1 is a top elevational view of a prior art specialty sheet.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

"Printer," "printer system," "printing system," "printer device," "printing device," and "multi-functional device (MFD)" as used herein encompass any apparatus, such as a digital copier, bookmaking machine, facsimile machine, multi-function machine, etc., which performs a print outputting function for any purpose.

Furthermore, as used herein, "sheet," "web," "substrate," "printable substrate," and "media" refer to, for example, paper, transparencies, parchment, film, fabric, plastic, photo-finishing papers, or other coated or non-coated substrate media in the form of a web upon which information or markings can be visualized and/or reproduced. By specialty sheet it is meant a sheet which includes a card, label, sticker, or other element that is thicker than the substrate on or in which it resides.

Referring now to the figures, FIG. 1 is a top elevational view of prior art specialty sheet 1. As shown, specialty sheet 1 comprises substrate 2 and at least one card or label or sticker, for example, cards 3A-B. Cards 3A-B have a thickness that is greater than substrate 2.

Figure 2A:
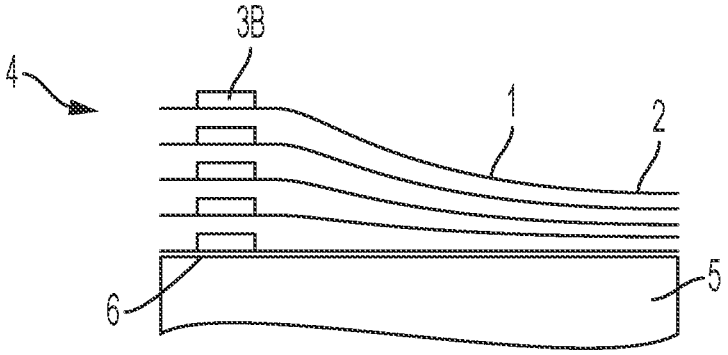
FIG. 2A PRIOR ART
FIG. 2A is a side elevational view of a prior art stack of specialty sheets arranged on a feeder tray.

FIG. 2A is a side elevational view of a prior art stack of specialty sheets 1 arranged on feeder tray 5 of a printing device. As shown, a plurality of specialty sheets 1 are stacked on top of each other forming stack 4 on surface 6 of feeder tray 5. Because cards 3A-B have a greater thickness than substrate 2, stack 4 comprises an uneven geometry, which causes feeding issues. As such, stack 4 as shown in FIG. 2 is said to be unlevel. By unlevel stack or unlevel, it is meant that the top sheet 1 of stack 4 is non-parallel to surface 6 or feeder tray 5. As previously described, such an unlevel stack causes issues with sheet feeding (input) or stacking (output).

Figure 2B:
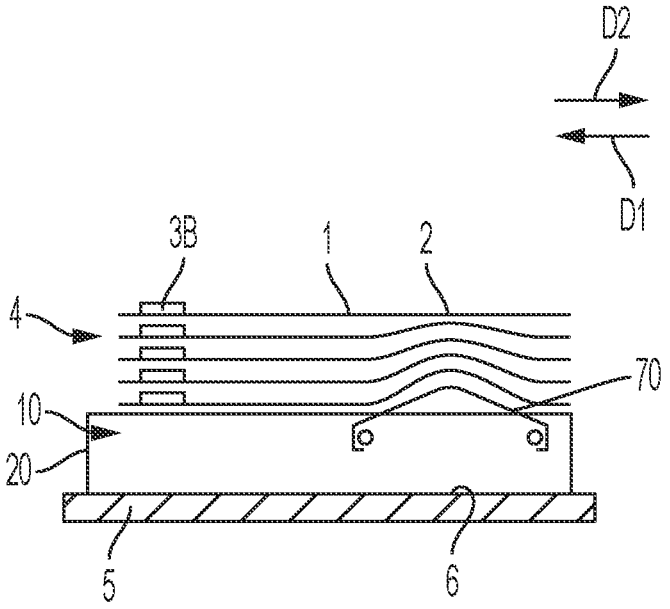
FIG. 2B is a cross-sectional schematic view of the printing device taken generally along line 2B-2B in FIG. 8.
Figure 8:
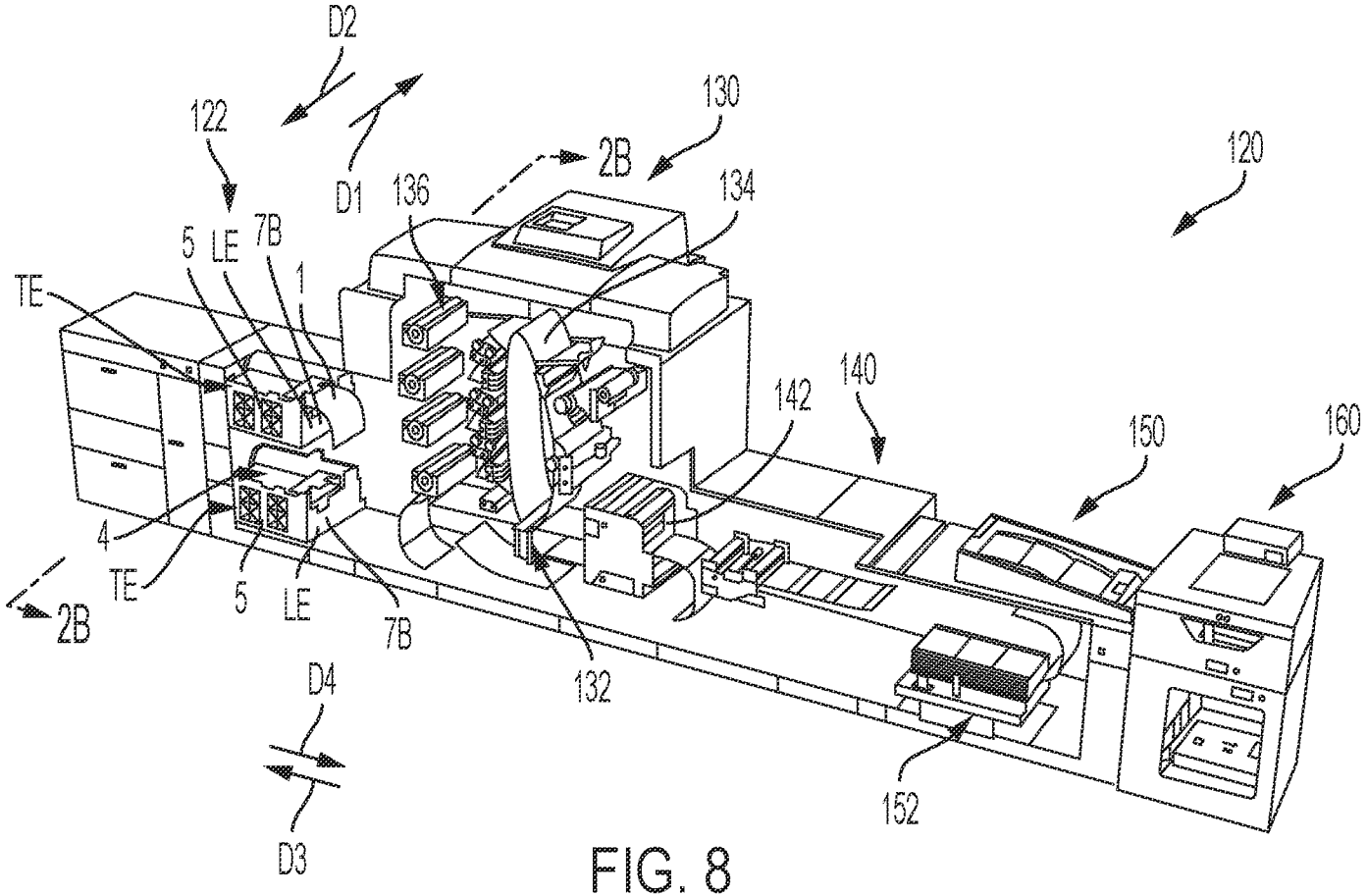

FIG. 2B is a cross-sectional schematic view of printing device 120 taken generally along line 2B-2B in FIG. 8. As shown, feeder tray 5 is modified by the arrangement of adjustable leveling assembly 10 on surface 6 (i.e., a removable mechanical modification). After arranging adjustable leveling assembly 10 on feeder tray 5, wedging element 70 is adjusted in direction D4 such that stack 4 is substantially level at its top sheet. As shown, wedging element 70 is displaced in direction D2 to offset the excessive elevation of stack 4 created by cards 3B. It should be appreciated that such a removable mechanical modification can also be implemented in stacker 152 (see FIG. 8) for example, with a second adjustable wedging element 10. Stack 4 as shown in FIG. 2B is said to be level. By level stack or level, it is meant that the top sheet 1 of stack 4 is parallel or substantially parallel to surface 6 or feeder tray 5. As previously described, such a level stack corrects any issues with sheet feeding (input) or stacking (output) caused by an unlevel stack. In some embodiments, wedging element 70 is slidably connected to feeder tray 5 along a direction perpendicular to sheet feeding or movement, namely, in direction D1 and direction D2, with direction D4 being the direction of paper feeding. In some embodiments, wedging element 70 is slidably connected to feeder tray 5 along a direction of or parallel to sheet feeding or movement, namely, in direction D3 and direction D4, with direction D4 being the direction of paper feeding.

Figure 3A:
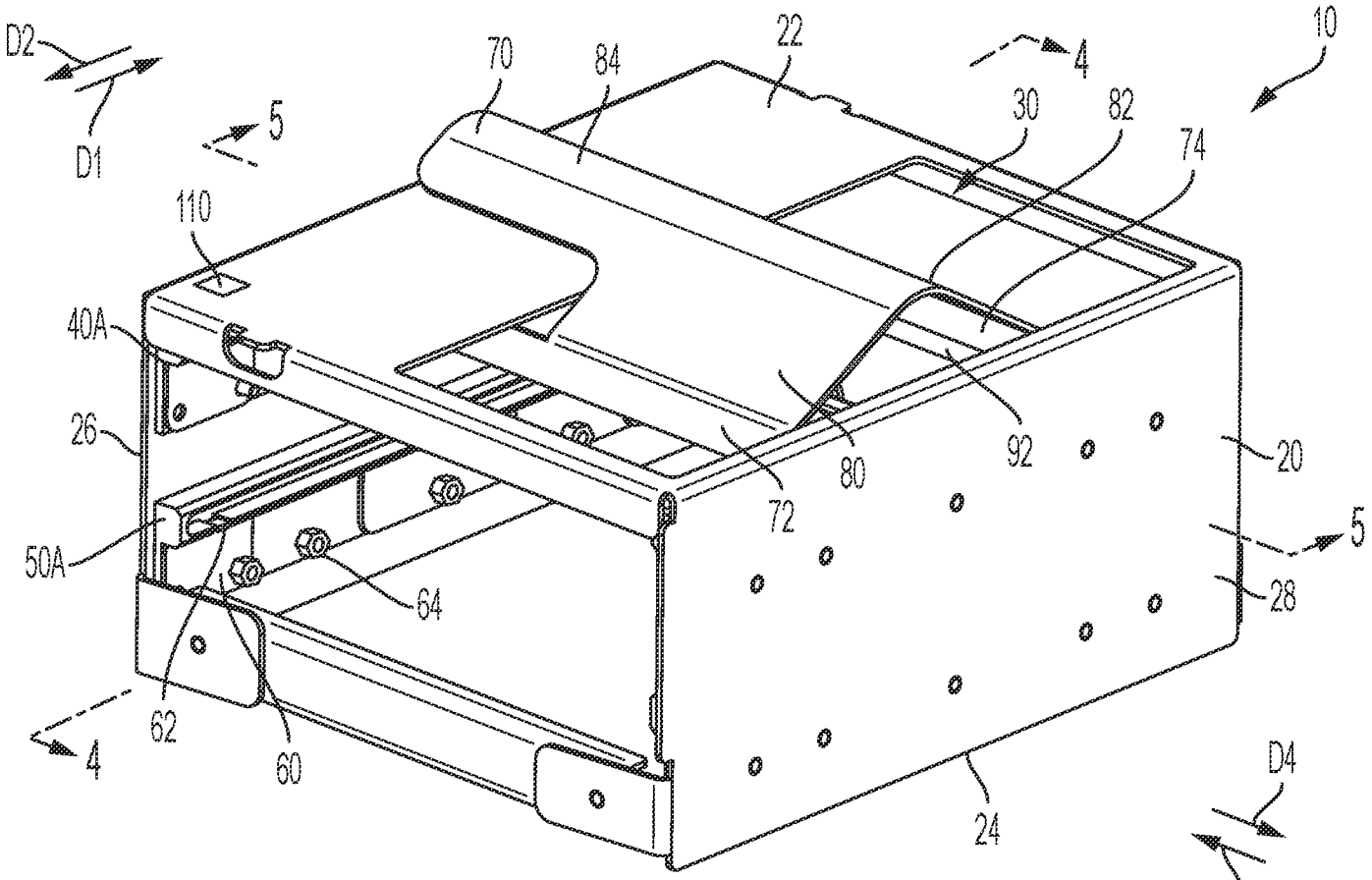
FIG. 3A is a front top perspective view of an adjustable leveling assembly.
Figure 3B:
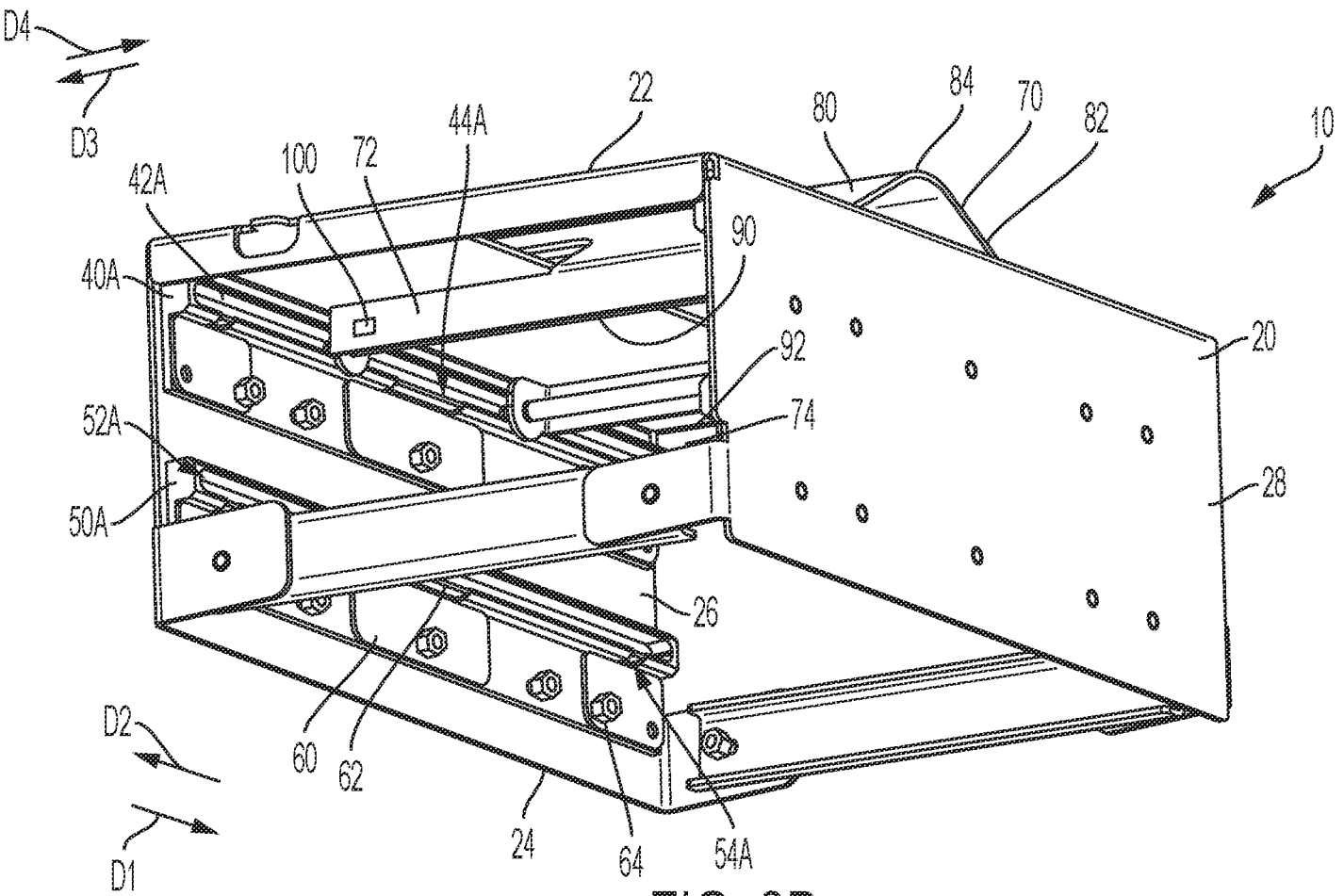
FIG. 3B is a front bottom perspective view of the adjustable leveling assembly shown in FIG. 3A.
Figure 3C:
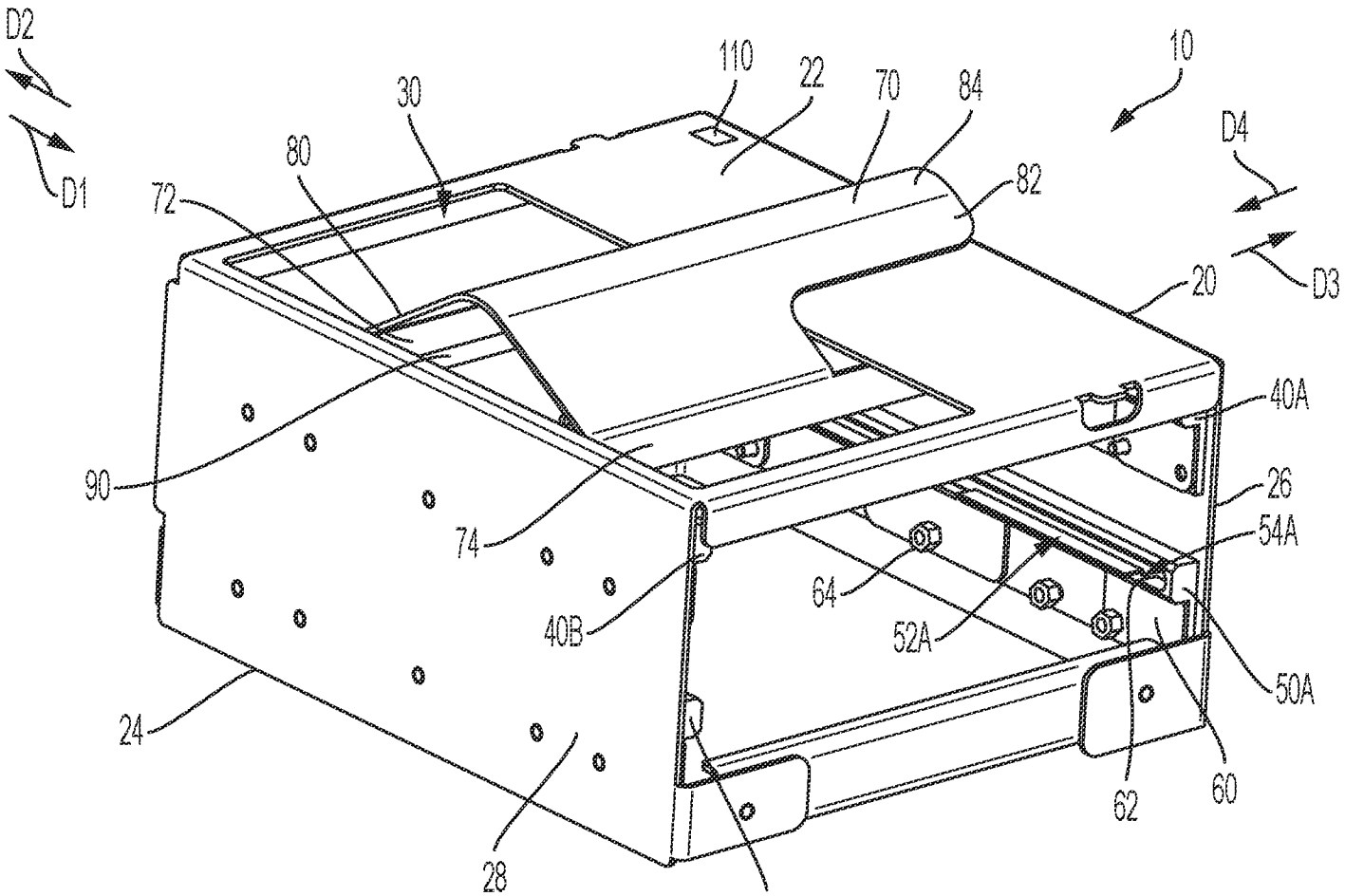
FIG. 3C is a rear top perspective view of the adjustable leveling assembly shown in FIG. 3A.
Figure 4:
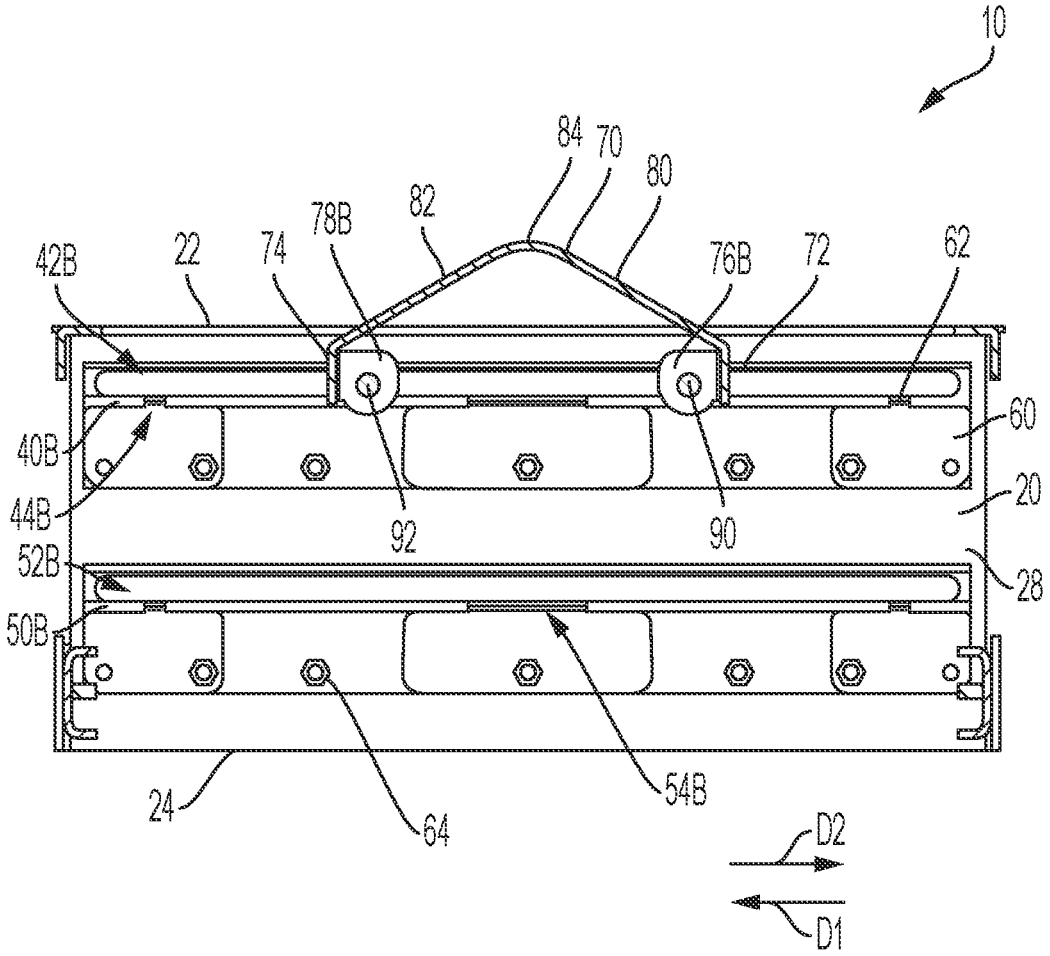
FIG. 4 is a cross-sectional view of the adjustable leveling assembly taken generally along line 4-4 in FIG. 3A.
Figure 5:
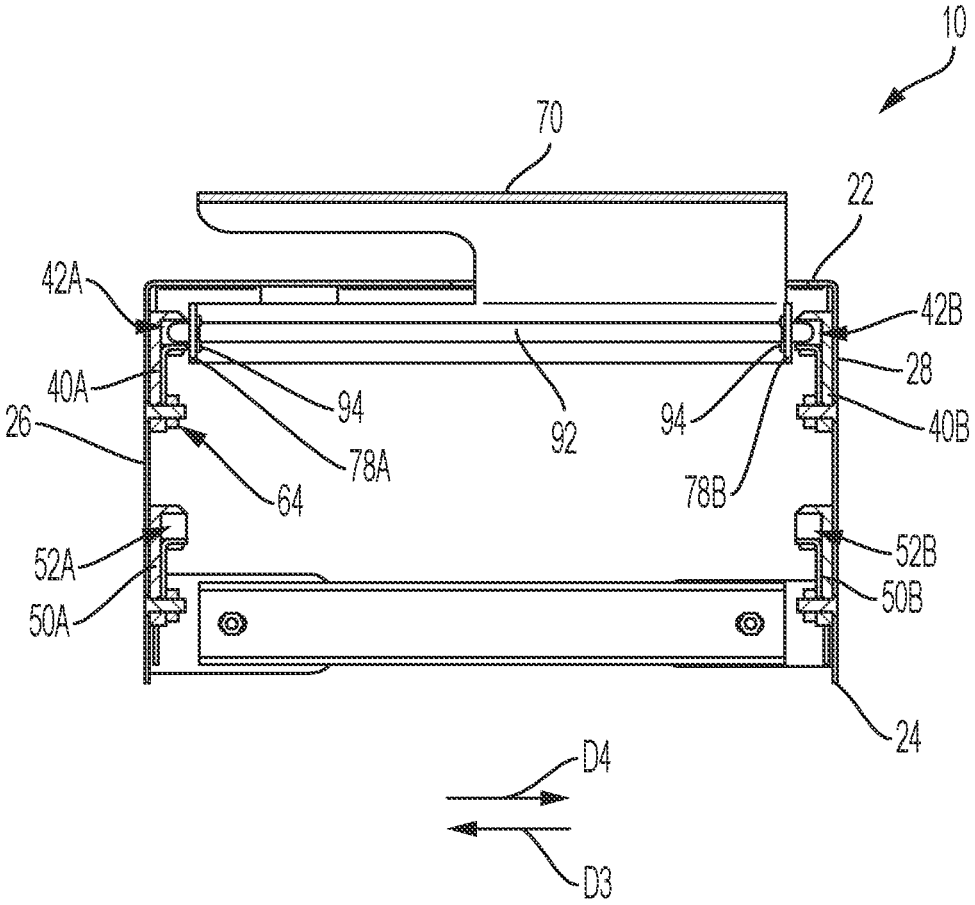
FIG. 5 is a cross-sectional view of the adjustable leveling assembly taken generally along line 5-5 in FIG. 3A.
Figure 6:
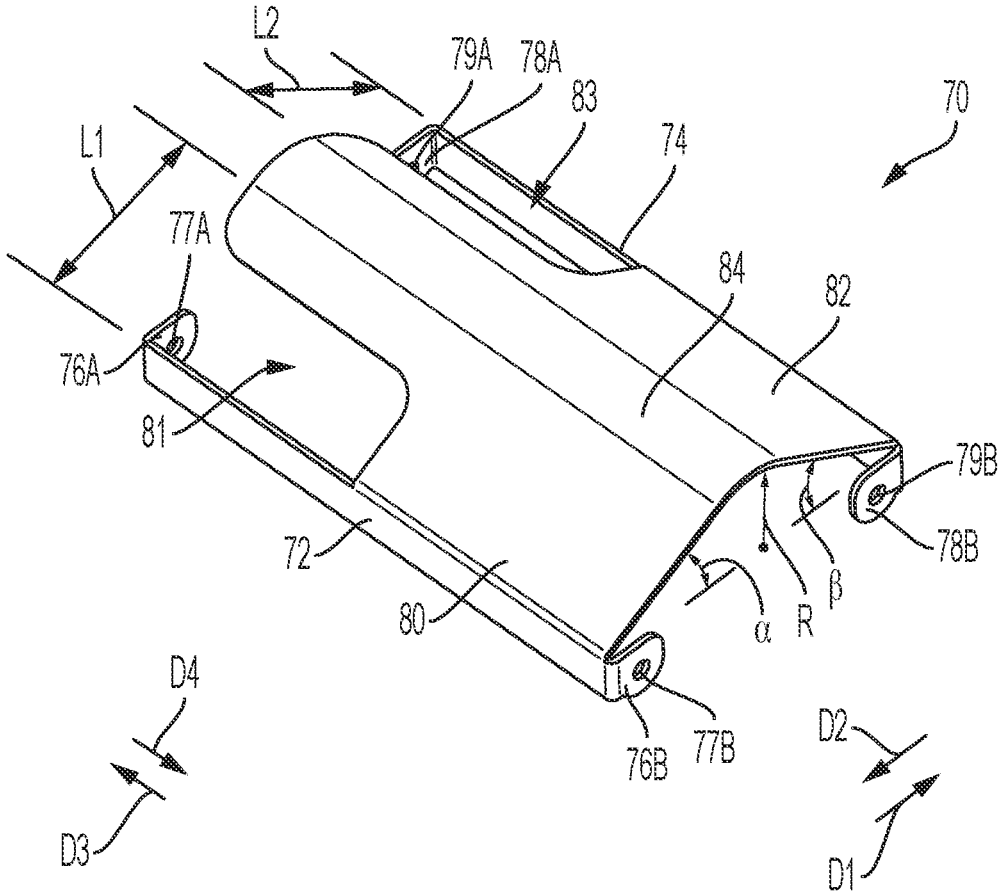
FIG. 6 is a front top perspective view of the wedging element shown in FIG. 3A.

FIG. 3A is a front top perspective view of adjustable leveling assembly 10. FIG. 3B is a front bottom perspective view of adjustable leveling assembly 10. FIG. 3C is a rear top perspective view of adjustable leveling assembly 10. FIG. 4 is a cross-sectional view of adjustable leveling assembly 10 taken generally along line 4-4 in FIG. 3A. FIG. 5 is a cross-sectional view of adjustable leveling assembly 10 taken generally along line 5-5 in FIG. 3A. FIG. 6 is a front top perspective view of wedging element 70. Adjustable leveling assembly 10 generally comprises body 20 and wedging element 70. In some embodiments, adjustable leveling assembly 10 further comprises one or more tracks or brackets, for example, tracks 40A-B and 50A-B. The following descriptions should be read in view of FIGS. 1-6.

Body 20 comprises top surface 22, bottom surface 24, side wall 26, and side wall 28. Bottom surface 24 is operatively arranged to engage, or be placed on top of, surface 6 of feeder tray 5 of a printing device. In some embodiments, bottom surface 24 is operatively arranged to be removably connected to top surface 6 of feeder tray 5. Top surface 22 is arranged substantially parallel to bottom surface 24 to engage a plurality of specialty sheets 1, namely, stack 4. In some embodiments, top surface 22 is arranged unparallel to bottom surface 24. Side wall 26 extends top surface 22 to bottom surface 24. Side wall 26 is connected to top surface 22 and bottom surface 24. In some embodiments, side wall 26 is fixedly secured to top surface 22 and bottom surface 24. Body 20 is generally box-shaped or shaped like a rectangular prism or cube, with open ends. However, it should be appreciated that the overall height of body 20 (i.e., the height of side walls 26 and 28) may be increased or decreased based on the printing device. Additionally, the dimensions of top surface 22 (i.e., length and width) may be adjusted for various size sheets (e.g., A0, A1, A2, letter, legal, tabloid, etc.). Top surface 22 comprises aperture 30. Aperture 30 is operatively arranged to engage wedging element 70 such that surfaces 80, 82, 84 protrude through top surface 22, as will be described in greater detail below.

In some embodiments, adjustable leveling assembly 10 further comprises tracks 40A-B and 50A-B. Track 40A is connected to side wall 26 and comprises channel 42A. Channel 42A is operatively arranged to engage wedging element 70, specifically rollers or axels 90 and 92, as will be described in greater detail below. In some embodiments, channel 42A comprises one or more spaces 44A. Spaces 44A allow rollers 90 and 92 to disengage channels 42A such that wedging element 70 can be removed from track 40A.

Track 40B is connected to side wall 28 and comprises channel 42B. Channel 42B is operatively arranged to engage wedging element 70, specifically rollers or axels 90 and 92, as will be described in greater detail below. In some embodiments, channel 42B comprises one or more spaces 44B. Spaces 44B allow rollers 90 and 92 to disengage channels 42B such that wedging element 70 can be removed from track 40B.

Track 50A is connected to side wall 26 and comprises channel 52A. Channel 52A is operatively arranged to engage wedging element 70, specifically rollers or axels 90 and 92, as will be described in greater detail below. In some embodiments, channel 52A comprises one or more spaces 54A. Spaces 54A allow rollers 90 and 92 to disengage channels 52A such that wedging element 70 can be removed from track 50A.

Track 50B is connected to side wall 28 and comprises channel 52B. Channel 52B is operatively arranged to engage wedging element 70, specifically rollers or axels 90 and 92, as will be described in greater detail below. In some embodiments, channel 52B comprises one or more spaces 54B. Spaces 54B allow rollers 90 and 92 to disengage channels 52B such that wedging element 70 can be removed from track 50B.

Tracks 40A and 40B are aligned and are operatively arranged to slidingly engage the "in-use" wedging element or wedging elements 70. By "in-use" it is meant that wedging element 70 protrudes through top surface 22 to engage sheets arranged thereon. Tracks 50A and 50B are aligned and are operatively arranged to slidingly engage the "stored" wedging element or wedging elements 170 and/or 270 (see FIG. 7). By "stored" it is meant that wedging element 170, 270 does not protrude through top surface 22, but rather resides completely between top surface 22 and bottom surface 24. In some embodiments, tracks 40A-B and 50A-B are connected to side walls 26 and 28 via bolts and nuts 64. It should be appreciated, however, that tracks 40A-B and 50A-B can be connected to side walls 26 and 28 via any suitable means, for example, screws, rivets, nails, pins, dowels, soldering, welding, adhesives, etc. It should also be appreciated that in some embodiments that tracks 40A-B and 50A-B are integrally formed with or in side walls 26 and 28 (i.e., channels that tracks 42A-B and 52A-B can be arranged directly in side walls 26 and 28).

In some embodiments, adjustable leveling assembly 10 further comprises one or more plates 60. Each of plates 60 comprises flange 62. Plates 60 are operatively arranged to be removably secured to side walls 26 and 28, or more specifically to tracks 40A-B and 50A-B, to block spaces 44A-B and 54A-B. For example, a user will select the wedging element with the desired dimensions and geometry, for example wedging element 70. Wedging element 70 is then inserted into in-use tracks 40A-B, specifically, into channels 42A-B through spaces 44A-B. Once rollers 90 and 92 are engaged with channels 42A-B, one or more plates 60 are secured to side walls 26 and 28, or tracks 40A and 40B, such that flanges 64 block spaces 44A-B to trap rollers 90 and 92 in channels 42A-B. The width of flanges 64 should be substantially equal to or just less than the width of spaces 44A-B to ensure that rollers 90 and 92 do not inadvertently fall out of channels 42A-B.

Similarly, the non-selected wedging elements are placed in stored tracks 50A-B, specifically in channels 52A-B through spaces 54A-B. Plates 60 are then secured to side walls 26 and 28, or tracks 50A and 50B, such that flanges 64 block spaces 54A-B to trap rollers 90 and 92 in channels 52A-B. The width of flanges 64 should be substantially equal to or just less than the width of spaces 54A-B to ensure that rollers 90 and 92 do not inadvertently fall out of channels 52A-B. Plates 64 can be removably connected to side walls 26 and 28, or tracks 50A and 50B, via any suitable means, for example, bolts, screws, nails, pegs, dowels, pins, rivets, snaps, etc.

Wedging element 70 is slidingly engaged with body 20. Wedging element 70 comprises cross-member 72, cross-member 74, and surfaces 80, 82, and 84. Cross-member 72 is slidingly engaged with side wall 26 and side wall 28, specifically, track 40A and track 40B. In some embodiments, cross-member 72 comprises flange 76A on a first end thereof and flange 76B on a second end thereof. In some embodiments, flange 76A is arranged perpendicular to cross-member 72. In some embodiments, flange 76A is arranged non-perpendicular to cross-member 72. In some embodiments, flange 76A extends in direction D1 or direction D2 from cross-member 72. In some embodiments, flange 76B is arranged perpendicular to cross-member 72. In some embodiments, flange 76B is arranged non-perpendicular to cross-member 72. In some embodiments, flange 76B extends in direction D1 or direction D2 from cross-member 72. Flange 76A and flange 76B comprise through-bore 77A and through-bore 77B, respectively.

Cross-member 74 is slidingly engaged with side wall 26 and side wall 28, specifically, track 40A and track 40B. In some embodiments, cross-member 74 comprises flange 78A on a first end thereof and flange 78B on a second end thereof. In some embodiments, flange 78A is arranged perpendicular to cross-member 74. In some embodiments, flange 78A is arranged non-perpendicular to cross-member 74. In some embodiments, flange 78A extends in direction D1 or direction D2 from cross-member 74. In some embodiments, flange 78B is arranged perpendicular to cross-member 74. In some embodiments, flange 78B is arranged non-perpendicular to cross-member 74. In some embodiments, flange 78B extends in direction D1 or direction D2 from cross-member 74. Flange 78A and flange 78B comprise through-bore 79A and through-bore 79B, respectively.

Surface 80 is connected to and extends from cross-member 72. Surface 80 comprises length L1 and is arranged at angle $\alpha$ relative to cross-member 72 (i.e., a horizontal plane drawn between cross-members 72 and 74). In some embodiments, surface 80 is planar. In some embodiments, surface 80 is curvilinear. It should be appreciated that length L1 and angle $\alpha$ of surface 80, as well as its geometry (e.g., planar, curvilinear, or both planar and curvilinear) can be adjusted for any unlevel geometry of stack 4. In some embodiments, and as shown, surface 80 comprises cutout 81 extending from a first end thereof in direction D4. Cutout 81 allows wedging element 70 to engage top surface 22. Thus, top surface 22 engages cutout 81 such that wedging element 70 can slide or displace relative to body 20 (i.e., surface 80 is arranged above top surface 22 and cross-member 72 is arranged below top surface 22).

Surface 82 is connected to and extends from cross-member 74. Surface 82 comprises length L2 and is arranged at angle $\beta$ relative to cross-member 74 (i.e., a horizontal plane drawn between cross-members 72 and 74). In some embodiments, surface 82 is planar. In some embodiments, surface 82 is curvilinear. It should be appreciated that length L2 and angle $\beta$ of surface 82, as well as its geometry (e.g., planar, curvilinear, or both planar and curvilinear) can be adjusted for any unlevel geometry of stack 4. In some embodiments, length L2 is equal to length L1. In some embodiments, length L2 is not equal to length L1. In some embodiments, angle $\beta$ is equal to angle $\alpha$. In some embodiments, angle $\beta$ is not equal to angle $\alpha$. In some embodiments, and as shown, surface 82 comprises cutout 83 extending from a first end thereof in direction D4. Cutout 83 allows wedging element 70 to engage top surface 22. Thus, top surface 22 engages cutout 83, and cutout 81, such that wedging element 70 can slide or displace relative to body 20 (i.e., surface 82 is arranged above top surface 22 and cross-member 74 is arranged below top surface 22).

Surface 84 is connected to and extends from surface 80 and surface 82. In some embodiments, surface 84 is curvilinear and comprises radius R. In some embodiments, surface 84 is planar. Surface 84 forms the peak or the highest point of wedging element 70. It should be appreciated that the dimensions of wedging element 70, namely, length L1, length L2, radius R, angle $\alpha$, angle $\beta$, and the geometry of surfaces 80, 82, and 84 are to be chosen such that when stack 4 is arranged on wedging element 70 and top surface 22, the top surface of stack 4 is level. This might require a wedging element having two separate and distinct peaks, or a S-shaped geometry.

As shown, cross-members 72 and 74 are arranged below top surface 22 while surfaces 80, 82, and 84 protrude through and extend above top surface 22. This allows specialty sheets 1, or more specifically stack 4, to engage both wedging element 70 and top surface 22. This arrangement also wedging element 70 to be displaced while stack 4 is arranged on adjustable leveling assembly 10 (i.e., stack 4 can be placed on top of surfaces 80, 82, and/or 84 and wedging element 70 can subsequently be adjusted relative to body 20).

As previously described, wedging element 70 is slidingly engaged with body 20 such that wedging element 70 is displaceable in directions D1 and D2 with respect to body. In some embodiments, adjustable leveling assembly 10 comprises rollers or axels 90 and 92. Roller 90 extends through cross-member 72, specifically through-bores 77A-B of flanges 76A-B, respectively, and engages tracks 40A-B. Roller 90 is rotatably connected to wedging element 70, and is secured axially thereto via one or more retaining elements or retaining rings 94. Retaining elements 94 may be arranged in a groove in roller 90. Roller 92 extends through cross-member 74, specifically through-bores 79A-B of flanges 78A-B, respectively, and engages tracks 40A-B. Roller 92 is rotatably connected to wedging element 70, and is secured axially thereto via one or more retaining elements or retaining rings 94 (see FIG. 5). Retaining elements 94 may be arranged in a groove in roller 90. It should be appreciated that wedging element 70, specifically, cross-members 72 and 74, may be slidingly engaged with body 20 via any suitable means.

In some embodiments, adjustable leveling assembly 10 comprises locking mechanism 100 operatively arranged to lock wedging element 70 with respect to body 20 (see FIG. 3B). In such embodiments, a wedging element having a suitable geometry is selected, for example wedging element 70, and arranged in in-use tracks 40A-B. The non-selected wedging elements, for example wedging elements 170, 270, are arranged in stored tracks 50A-B (see FIG. 7). Wedging element 70 is then displaced in direction D1 or direction D2 with respect to body 20 until positioned in its desired location. Then locking mechanism 100 is engaged to fix wedging element 70 in that position. It should be appreciated that any locking mechanism suitable for temporarily fixing wedging element 70 with respect to body 20 may be used, for example, set screws, bolts, screws, rivets, magnets, cotter pins, retaining rings and elements, friction, etc. It should also be appreciated that in some embodiments, wedging element 70 may be more permanently fixed with respect to body 20 using, for example, adhesives, welding, soldering, etc. Locking mechanism 100 can also be arranged on any component. For example, while locking mechanism 100 is shown arranged on wedging element 70, it can also be arranged on body 20, tracks 40A and/or 40B, or rollers 90 and/or 92. Furthermore, a locking mechanism or mechanisms can be employed to fix the non-selected wedging elements (i.e., wedging elements 170, 270) arranged in the stored tracks 50A-B to body 20.

Figure 7:
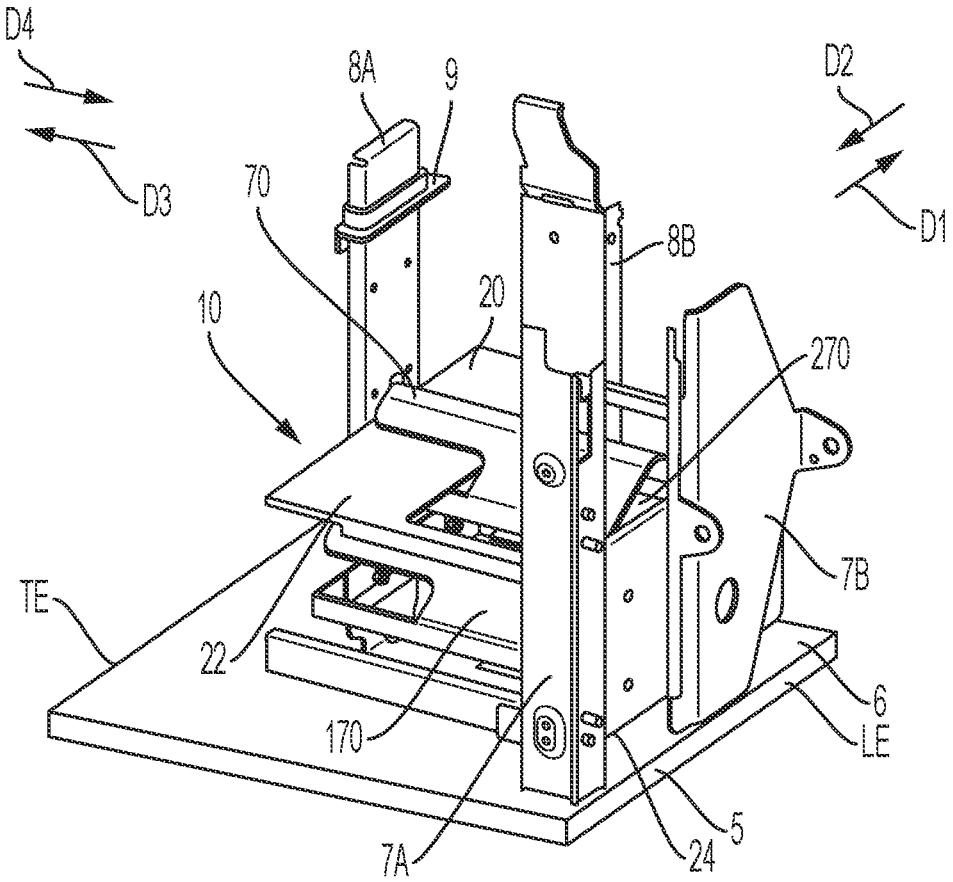
FIG. 7 is a front top perspective view of an adjustable leveling assembly arranged on a feeder tray; and, FIG. 8 is a partial perspective view of a printing device.

FIG. 7 is a front top perspective view of adjustable leveling assembly 10 arranged on feeder tray 5. As shown, adjustable leveling assembly 10 comprises body 20, one in-use wedging element 70, and two stored wedging elements 170 and 270. Body 20 is arranged such that bottom surface 24 is engaged with feeder tray 5. Bottom surface 24 may be removably connected to, or arranged on top of, surface 6 of feeder tray 5. Feeder tray 5, and specifically the printing device, may comprise static side walls 7A-B, which abut against or are arranged adjacent to body 30. Feeder tray 5, and specifically the printing device, may further comprise movable guides 8A-B. Moveable guide 8A is operatively arranged to displace in directions D3 and D4, and moveable guide 8B is operatively arranged to displace in directions D1 and D2. Static side walls and moveable guides are known in the art and are arranged adjacent feeder tray 5 to maintain alignment of the stack of sheets arranged thereon. Moveable guide 8A may comprise a paper trail edge 9 that indicates the top of the stack of sheets arranged on feeder tray 5. The sheets in the stack are fed to the printing device in direction D4, over the top of static side wall 7B.

Adjustable leveling assembly 10 arranged on surface 6 of feeder tray 5 and between static side walls 7A-B and moveable guides 8A-B. As previously described, the dimensions of body 20, specifically top surface 22, are chosen to correspond to the sheet size to be arranged thereon (e.g., A3, A4, A5, letter, etc.). The dimensions and geometry (e.g., length L1, length L2, radius R, angle $\alpha$, angle $\beta$, etc.) of the in-use wedging element 70 are chosen based on the curvature or unlevel geometry of stack 4 such that, when stack 4 is arranged on wedging element 70 and top surface 22, the top of stack 4 is level or otherwise planar.

Stored wedging elements 170 and 270 are substantially similar to wedging element 70 with respect to its elements; however, wedging elements 170 and 270 are different from wedging element 70 with respect to their dimensions and geometry. Since wedging elements 70, 170, and 270 each differ in dimensions and geometry from each other, a user can select a wedging element for specific specialty sheets 1. For example, the user would select the wedging element that, when specialty sheets 1 are arranged thereon, results in a level top surface of stack 4. The other wedging elements can be stored on tracks 50A-B. It should be further appreciated that a user may select two in-use wedging elements. In such embodiments, two wedging elements are arranged in tracks 40A-B to create a custom curvature, for example, having two peaks.

In some embodiments, adjustable leveling assembly 10 further comprises wireless communication device or transponder or transmitter or transmission device 110. Wireless communication device 110 is operatively arranged to transmit data to a remote location. In some embodiments, the transmitted data indicates the location of adjustable leveling assembly 10 geographically. In some embodiments, the transmitted data indicates which printing device or feeder tray adjustable leveling assembly is arranged in. This is desirable because a single location (i.e., building) may have a plurality of printing devices but only one adjustable leveling assembly 10. As such, it is desirable for users to know which printing device already incorporates adjustable leveling assembly 10 (i.e., if the user needs to print specialty sheets, the user can utilize that specific printer since adjustable leveling assembly 10 is already there). In some embodiments, the transmitted data indicates that the user must attend to the stacker of the printing device, the stacker being the device that stacks the printed sheets, or the output of the printing device. Specialty sheets 1 will again be compiled into a stack at the output stacker of the printing device and thus exhibit an uneven geometry. As such, the user must remove the specialty sheets 1 from the stack during printing to prevent the stack from getting too high. The data may be transmitted to a cellular device or tablet, a computing device, and/or the graphic user interface or digital front end of the printing device.

It should be appreciated that in some embodiments, adjustable leveling assembly 10 is fixedly secured to or integrally formed with feeder tray 5. Put another way, in such embodiments feeder tray 5 of a printing device incorporates adjustable leveling assembly 10 therein such that top surface 22 can be used for regular sheets without wedging elements 70, 170, 270 and for specialty sheets with wedging elements 70, 170, 270.

FIG. 8 is a partial perspective view of printing device 120. In some embodiments, printing unit 120 may be, for example, a XEROX® IGEN® printer, XEROX® BRENVA® printer, or XEROX® BALTORO® printer. Generally, printing device 120 comprises feeder module 122, print engine tower 130, fuser module 140, and output module 150. In some embodiments, printing device 120 further comprises finishing or post process module 160. The substrate or printable media travels through printing device 120 in direction D4.

Feeder module 122 feeds substrates into print engine tower 130. Feeder module 122 comprises one or more feeder trays 5. Feeder trays 5 of feeder module 122 can be modified, for example, with adjustable leveling assembly 10 as described above.

Print engine tower 130 comprises one or more dry ink dispensers, for example, dry ink dispensers 136, and transfer belt 134. Although a xerographic (i.e., toner) print engine is shown, adjustable leveling assembly 10 and the method of managing removable modifications to a printing device of the present disclosure can be used in wet ink (i.e., ink jet) or other printing technologies. In some embodiments, print engine tower 130 further comprises image transfer device 132. Some embodiments, e.g., embodiments including image formation by a dry ink, may benefit by printing systems that include what is known as an acoustic transfer assist (ATA) device. One of ordinary skill in the art will appreciate that printing systems that use a flexible belt in the process of forming an image thereon and subsequently transferring that image from the flexible belt to print media sometimes include one or more ATA devices. ATA devices use acoustic energy to drive the dry ink, e.g., toner, from the belt to the print media. Thus, in some embodiments, image transfer device 132 is an ATA device that assists with transferring a dry ink from a belt to the malleable print media so that no direct contact between the belt and malleable material is necessary. It should be appreciated that such an arrangement may minimize image defects and thereby increase image quality. However, it should also be appreciated that conventional transfer of ink or marking material from a drum or other solid object is also possible.

Fuser module 140 comprises fuser 142. Fuser 142 applies heat and/or pressure to the printable media or specialty sheet 1 to fuse dry ink to substrate 2, card 3A, and/or card 3B. In some embodiments, fuser 142 comprises two rollers through which specialty sheet 1 is passed through. Print engine tower 130 and fuser module 140 apply or "print" and fuse ink onto substrate 2, card 3A, and/or card 3B.

Output module 150 presents the finished printable media for retrieval. Output module 150 comprises stacker 152 that stacks the finished sheets, for example, specialty sheets 1.

Finishing module 160 applies various finishing details to the print job, for example, stapling, hole punching, binding, lamination, etc.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

1 Specialty sheet
2 Substrate
3A Card or label or sticker
3B Card or label or sticker
4 Stack
5 Feeder tray
6 Surface
7A Static wall
7B Static wall
8A Movable guide
8B Movable guide
9 Paper trail edge
10 Adjustable leveling assembly
20 Body
22 Top surface
24 Bottom surface
26 Side wall
28 Side wall
30 Aperture
40A Track
40B Track
42A Channel
42B Channel
44A Spaces
44B Spaces
50A Track
50B Track
52A Channel
52B Channel
54A Spaces
54B Spaces
60 Plate(s)
62 Flange(s)
64 Nuts and/or bolts
70 Wedging element
72 Cross-member
74 Cross-member
76A Flange
76B Flange
77A Through-bore
77B Through-bore
78A Flange
78B Flange
79A Through-bore
79B Through-bore
80 Surface
81 Cutout
82 Surface
82 Cutout
84 Surface
90 Roller or axel
92 Roller or axel
94 Retaining element or retaining ring
100 Locking mechanism
110 Wireless transmission device or transponder or transmitter or transmission device
120 Printing device
122 Feeder module
130 Print engine tower
132 Image transfer device
134 Transfer belt
136 Ink dispensers
140 Fuser module
142 Fuser
150 Output module
152 Stacker
160 Finishing or post-process module
170 Wedging element
270 Wedging element
D1 Direction
D2 Direction D3 Direction
D4 Direction
L1 Length
L2 Length
LE Leading edge
R Radius
TE Trailing edge
α Angle
β Angle

What is claimed is:

1. An adjustable leveling assembly for engaging a stack of a plurality of sheets in a tray of a printing device, comprising:
- a body including:
  - a top surface;
  - a bottom surface operatively arranged to engage the tray;
  - a first side wall extending from the top surface to the bottom surface; and
  - a second side wall extending from the top surface to the bottom surface, the second side wall being spaced apart from the first side wall;
- a first wedging element including:
  - a first cross-member engaged with the first side wall and the second side wall;
  - a second cross-member engaged with the first side wall and the second side wall, the second cross-member spaced apart from the first cross-member; and,
  - at least one surface that extends between the first cross-member and the second cross-member;
- wherein, the first wedging element is slidably received within the body and operatively arranged to engage the stack;
- wherein, when the first wedging element is disengaged with the stack, a top sheet of the plurality of sheets is non-parallel to the tray; and,
- when the first wedging element is engaged with the stack, the top sheet is substantially parallel to the tray.

2. The adjustable leveling assembly as recited in claim 1, wherein the at least one surface comprises:
- a first surface extending from the first cross-member;
- a second surface extending from the second cross-member; and,
- a third surface connecting the first surface and the second surface.

3. The adjustable leveling assembly as recited in claim 2, wherein:
- the first surface and the second surface are planar; and,
- the third surface is curvilinear.

4. The adjustable leveling assembly as recited in claim 2, further comprising a cutout arranged in at least one of the first surface and the second surface.

5. The adjustable leveling assembly as recited in claim 1, wherein:
- the first cross-member and the second cross-member are arranged below the top surface; and,
- the at least one surface is arranged above the top surface.

6. The adjustable leveling assembly as recited in claim 5, wherein the top surface comprises an aperture and the at least one surface extends through the aperture.

7. The adjustable leveling assembly as recited in claim 1, further comprising a first pair of tracks, wherein the first wedging element is engaged with the first pair of tracks via at least one roller.

8. The adjustable leveling assembly as recited in claim 7, further comprising a second pair of tracks spaced apart from the first pair of tracks and a second wedging element, wherein the second wedging element is engaged with the second pair of tracks.

9. The adjustable leveling assembly as recited in claim 7, wherein each track of the first pair of tracks comprises a channel and at least one space.

10. The adjustable leveling assembly as recited in claim 9, further comprising at least one plate operatively arranged to be removably engaged with the at least one space.

11. The adjustable leveling assembly as recited in claim 1, further comprising a locking mechanism operatively arranged to fixedly secure the first wedging element with respect to the tray.

12. The adjustable leveling assembly as recited in claim 1, further comprising a transmission device operatively arranged to transmit data to a remote location.

13. The adjustable leveling assembly as recited in claim 1, wherein the first wedging element is slidably displaceable relative to the tray in a direction perpendicular to sheet feeding.

14. An adjustable leveling assembly for engaging an unlevel stack of a plurality of sheets in a tray of a printing device, comprising:
- a body, including:
  - a top surface comprising an aperture;
  - a bottom surface operatively arranged to engage the tray;
  - a first side wall extending from the top surface to the bottom surface;
  - a second side wall extending from the top surface to the bottom surface and spaced apart from the first side wall; and,
- a first wedging element slidably received in the body and having a portion thereof that extends through the aperture;
- wherein the first wedging element comprises:
  - a first cross-member engaged with the first side wall and the second side wall;
  - a second cross-member engaged with the first side wall and the second side wall; and,
  - at least one surface that extends between the first cross-member and the second cross-member;
- wherein, the first wedging element is operatively arranged to engage the unlevel stack to form a level stack.

15. The adjustable leveling assembly as recited in claim 14, further comprising:
- a first channel connected to the first side wall; and,
- a second channel connected to the second side wall;
- wherein the first wedging element is engaged with the first channel and the second channel via at least one roller.

* * * * *